US008164450B2

(12) United States Patent
Cho

(10) Patent No.: US 8,164,450 B2
(45) Date of Patent: Apr. 24, 2012

(54) INITIATIVE WARNING SYSTEM

(76) Inventor: Ming-Pao Cho, Kaohsiung (TW)

( * ) Notice: Subject to any disclaimer, the term of this patent is extended or adjusted under 35 U.S.C. 154(b) by 400 days.

(21) Appl. No.: 12/498,638

(22) Filed: Jul. 7, 2009

(65) Prior Publication Data

US 2010/0039258 A1 Feb. 18, 2010

(30) Foreign Application Priority Data

Aug. 13, 2008 (TW) ..... 97130858 A

(51) Int. Cl.
*G08B 13/14* (2006.01)

(52) U.S. Cl. ..... 340/568.1; 340/539.1; 340/539.22

(58) Field of Classification Search ..... 340/568.1, 340/539.1, 539.72

See application file for complete search history.

(56) References Cited

U.S. PATENT DOCUMENTS 5,319,698 A * 6/1994 Glidewell et al. ..... 379/39
2006/0181425 A1 * 8/2006 Crane et al. ..... 340/612

* cited by examiner

*Primary Examiner* — Travis Hunnings
(74) *Attorney, Agent, or Firm* — Muncy, Geissler, Olds & Lowe, PLLC

(57) ABSTRACT

An initiative warning system comprises a protective area for accommodating objects and defining an area network, a plurality of sensors respectively installed on the objects, a detecting mainframe connected with the area network, and a terminal communicated with the detecting mainframe through the area network. Wherein, the arrangement of the area network promotes the connection between the detecting main frame and substitutes the conventional wiring allocation, so as to streamline installations of the detecting mainframe and the sensors. Additionally, the sensors can regularly transmit oscillating signals to the detecting mainframe for a further recognition and comparison. Thus, a controlling signal would be timely sent to trigger a warning command showing on the terminal through the area network when the compatible signals between the sensors and the detecting mainframe are not detected by the detecting mainframe, thereby preferably attaining an active warning effect.

5 Claims, 6 Drawing Sheets

INITIATIVE WARNING SYSTEM

BACKGROUND OF THE INVENTION

1. Field of the Invention

The present invention relates to a safety system, particularly to an initiative warning system.

2. Description of the Related Art

Usually, houses or shops would equip with alarm systems or safety devices indoor to prevent or improve the occurrence of the burglary. Referring to FIG. 1 shows a conventional alarm system 1 that essentially comprises a connecting wire 10 distributively arranged around a house or a building 2, a plurality of sensors 11 connecting with the wire 10, and a detecting mainframe 12 communicated with the wire 10. Wherein, the sensors 11 are respectively installed on the doors 21 and windows 22 of the house 2. The connecting wire 10 separately surrounds the house 2 accordingly to the positions of the sensors 11, so as to output the signal generated by the sensors 11 to the detecting mainframe 12. A plurality of apertures are commonly disposed at the positions of the sensors 11 for acting as shelters to hide the connecting wire 10. In addition, each sensor 11 further includes a magnetic reed sensor 111 and a signal wire 112 outwardly extended from the magnetic reed sensor 111, so that the signal wire 112 is able to connect and communicate with the connecting wire 10. Moreover, the detecting mainframe 12 includes a processing unit 121 attached to the connecting wire 10 and a siren 122 connected to the processing unit 121.

In use, the sensors 11 are respectively installed on the doors 21 and windows 22, and the connecting wire 10 is accordingly arranged around the house 2 and connected with the detecting mainframe 12 for making predetermined settings. Afterward, when people are out of the house 2 or not in business hours, the magnetic reed sensors 111 would sense the motions of the doors 21 and the windows 22 while they are opened and hence drive a connection with the connecting wire 10 to trigger the sounding of the siren 122 for cautioning the thief.

However, the conventional alarm system 1 has some shortcomings:

1. Maybe the arrangement of the apertures can be previously reserved for hiding the connecting wire 10 to maintain a good appearance while installing, but the dispositions of the apertures are still limited without departing from the extent of the house. If the installation extends, users inevitably need to pay more attention to dispose more connecting wires 10 for accomplishing the wiring process as such wiring process is usually complicated. With respect to the current application, the distribution of the connecting wire 10 and the installation of the detecting mainframe 12 are essentially placed complying with numbers of the doors 21 and the windows 22 and with the distance therebetween, the more the doors 21 and windows 22 are included, the more complicated arrangement of the connecting wires 10 is required. Thus, the environment within the house 2 would become untidiness due to the complex allocation, and the over installing extent of the system also incur an inconvenience.
2. Further, the sensors 11 are suitably installed on the doors 21 and the windows 22 within a limitedly closed area (e.g. the house 2) but are unable to be well applied to an open area or portable objects. As long as intruders malevolently break the sensors 11 and rush into the house, the valuable property therein would be apparently free to the intruders. In this manner, the allowable protective scope of the conventional alarm system 1 is restricted. Further, if the protective scope is directed to an open area which is free to enter, such as a motel and school, the occurrence of the pilferage is on the increase in those places because the alarm system 1 becomes useless and fails to take any threatens to the intruders. Therefore, the conventional alarm system 1 still requires improvements.

SUMMARY OF THE INVENTION

Therefore, the objective of the present invention is to offer an initiative warning system that attains the merits of a convenient installation and an instant warning effect.

The initiative warning system in accordance with the present invention essentially comprises a protective area for placing objects, an area network disposed within the protective area and communicated with an exterior, a plurality of sensors respectively installed on the objects, a detecting mainframe connected with the area network, and a terminal connected with the detecting mainframe through the area network. Wherein, the sensors installed on the objects output signals to the detecting mainframe, and which further confirms receipt of the signals for executing a decoding, an analysis, and a comparison, and recognizes whether the signals are in response to a predetermined code stored therein. Once the detecting mainframe cannot receive the signals from the sensors, a controlling signal would be output via the area network to the terminal to advance a warning. Therefore, the present alarm system needs not the complicated wiring and significantly applies the communication of the area network and the above elements to achieve an effective warning efficiency.

The advantages of the present invention will become more apparent by reading the following descriptions with the relating drawings.

DETAILED DESCRIPTION OF THE PREFERRED EMBODIMENTS

Figure 1:
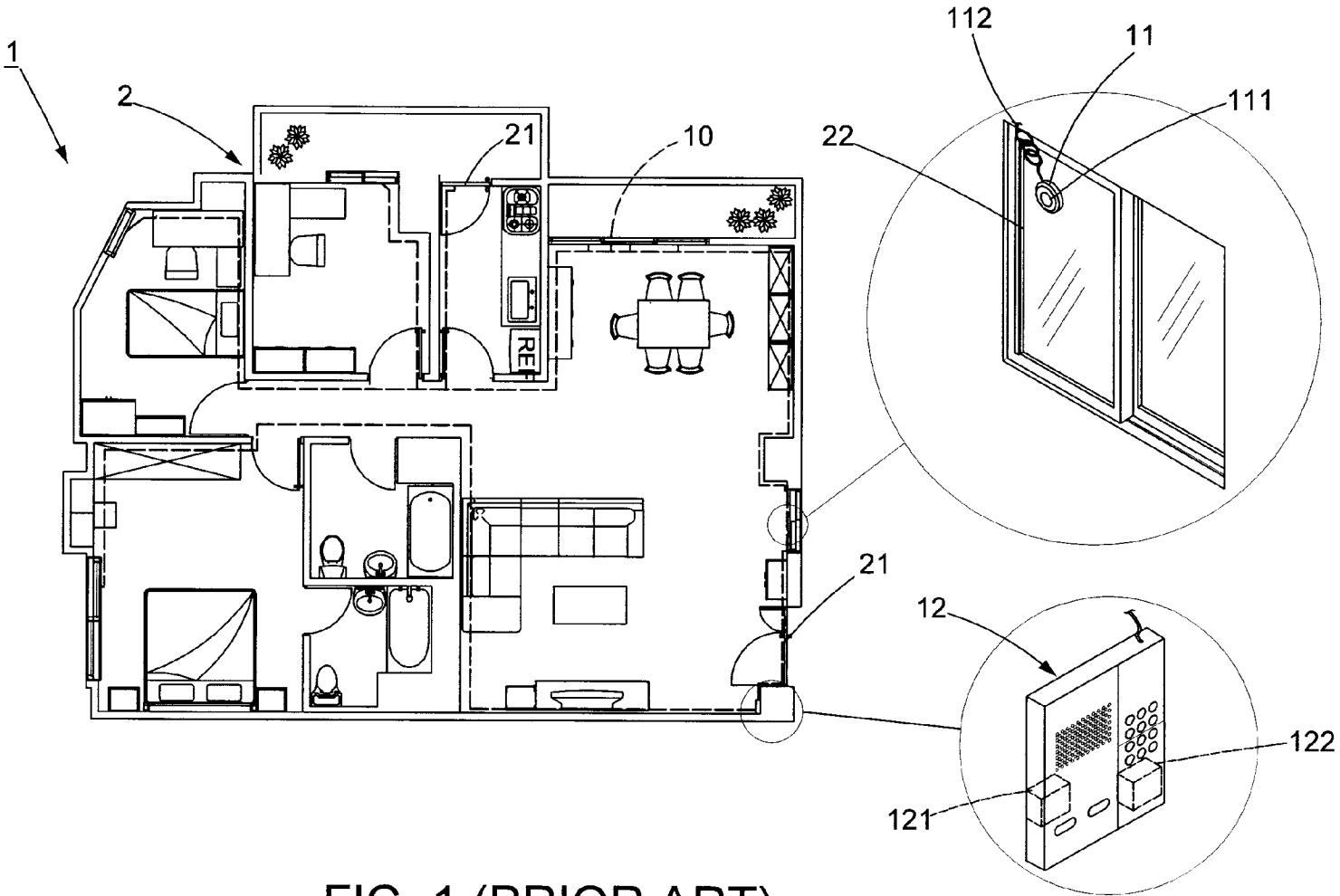
FIG. 1 (PRIOR ART)
FIG. 1 is a plan view of a conventional alarm system.
Figure 2:
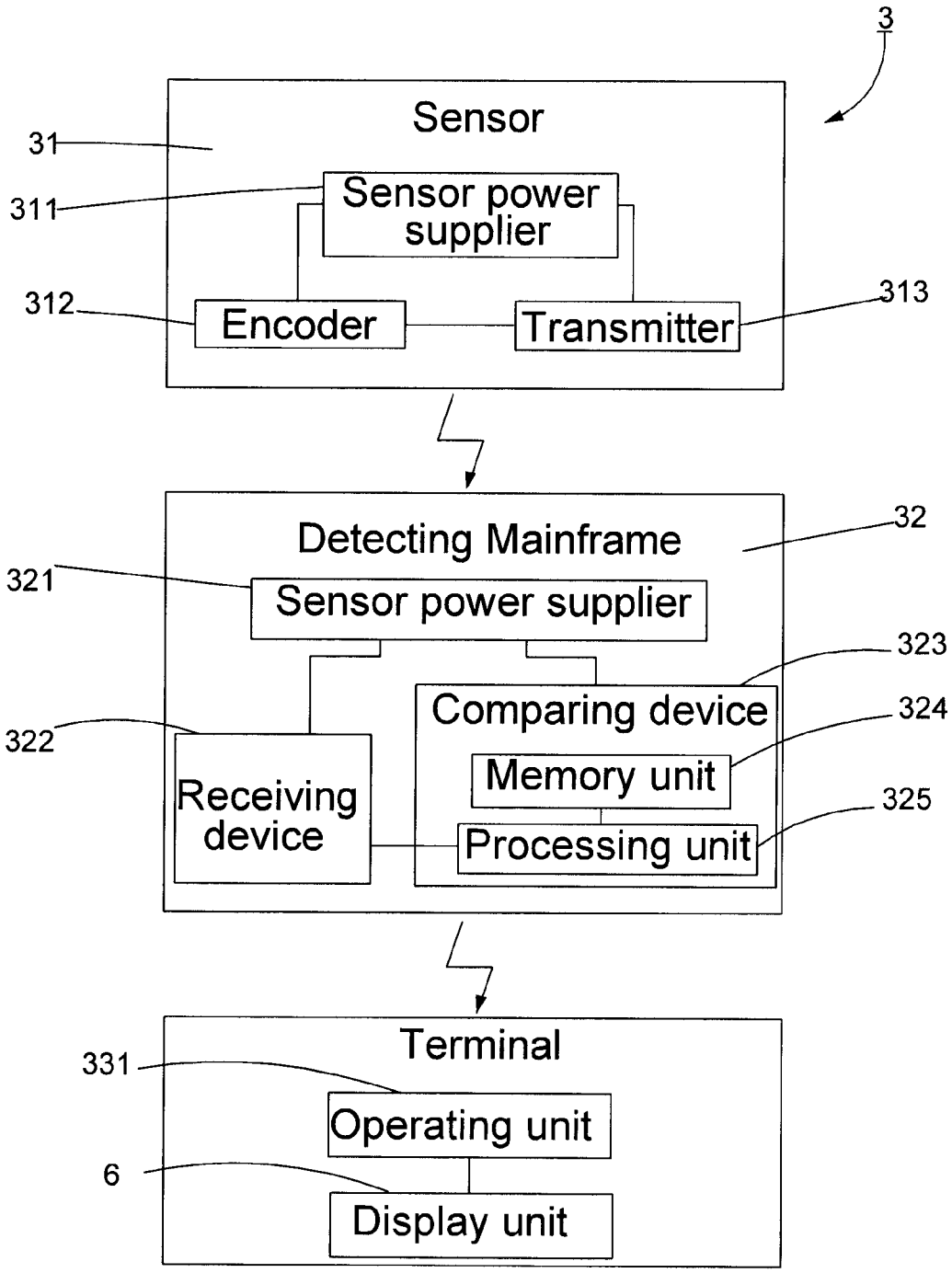
FIG. 2 is a flow diagram of a first embodiment of the present invention.
Figure 3:
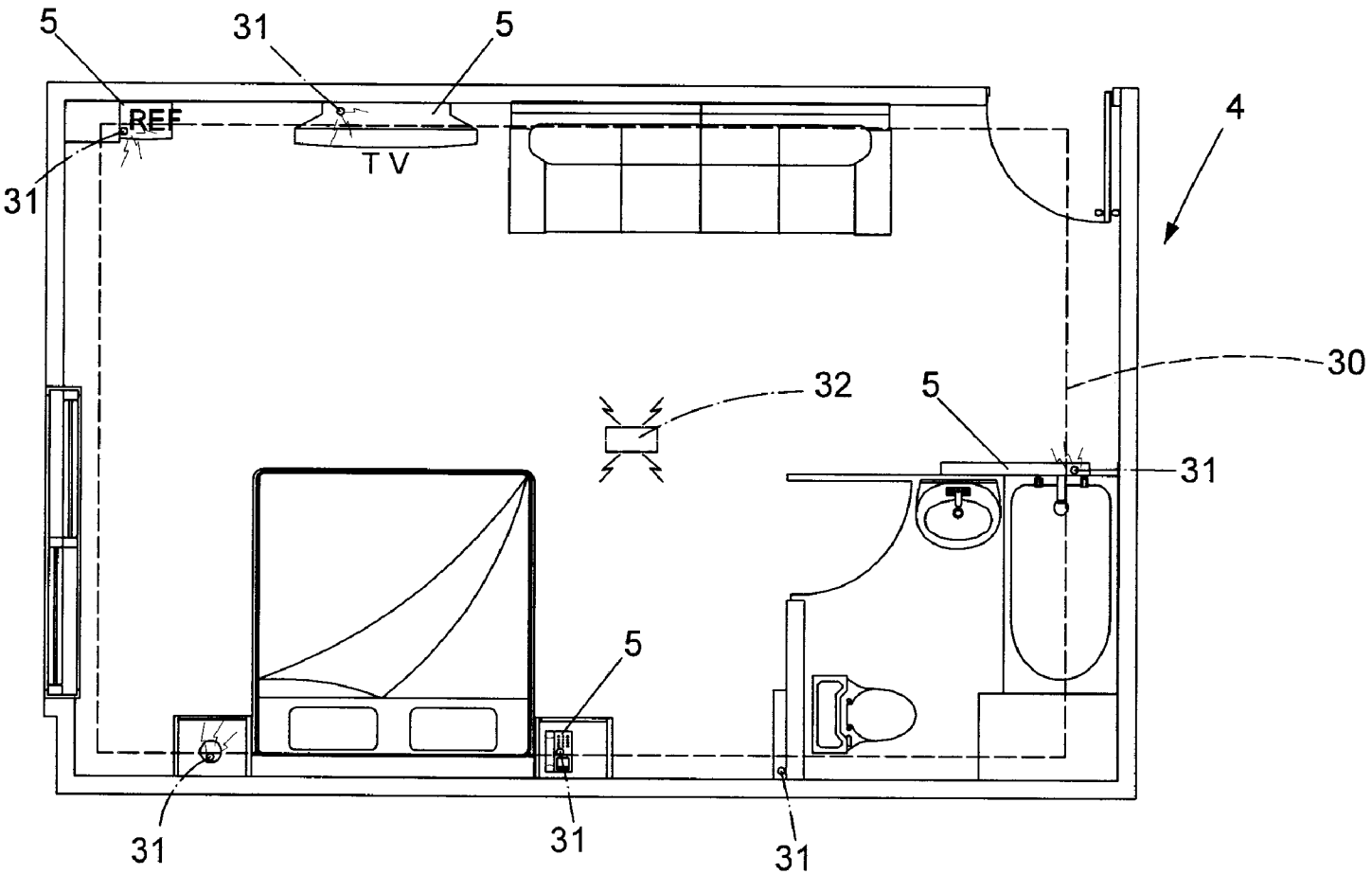
FIG. 3 is a partial plan view of the present invention.

Referring to FIGS. 2 and 3 shows a first preferred embodiment of the initiative warning system 3 of the present invention which comprises a protective area 4 defining an area network 30 communicated with the outside, a plurality of sensors 31 respectively disposed on different objects 5, a detecting mainframe 32 attached to the area network 30, and a terminal 33 connected to the detecting mainframe 32 through the area network 30. Wherein, the protective area 4 could be as a closed area (e.g. a home) or an open-public area (e.g. a school, a superstore, or a motel). In following descriptions the protective area 4 is directed to a motel which contains multiple objects and equipments 5 placed in each room, for example a TV, various electric appliances and ornaments.

Further, each sensor 31 has a sensor power supplier 311 respectively connected to an encoder 312 and a transmitter 313. Wherein, the sensor power supplier 311 could be a dry battery or be contacted with an electric supplier of the objects 5 (not shown), so that the sensor power supplier 311 provides the encoder 312 and the transmitter 313 with electricity. Besides, the encoder 312 correspondingly generates an encoded signal compatible with a previously stored code within the detecting mainframe 32 in time of production for giving specific identities of the sensor 31 and the detecting mainframe 32. The encoder 312 could apply an oscillator (not shown) to transform the encoded signal into an analog signal that is further transmitted from the transmitter 313 to the detecting mainframe 32. Alternatively, the transmitter 313 could be employed to incessantly or intermittently transmit the analog signal to the detecting mainframe 32. Herein, the intermittent radiation of the signal sent from the transmitter 313 is adopted in the embodiment for reducing the power consumption of the sensor power supplier 311.

Moreover, the detecting main frame 32 has a main frame power supplier 321 respectively connected to a receiving device 322 and a comparing device 323. Wherein, the receiving device 322 receives the analog signal transmitted by the transmitter 313 and thence proceeds to recognize, decode, and transform the analog signal into a decoded signal for the comparing device 323 to read. In addition, the comparing device 323 includes a memory unit 324 saving the aforementioned predetermined stored code in correspondence with the encoded signal created by the sensors 31 and a processing unit 325 connected with the memory unit 324; wherein, the processing unit 325 acts to confirm receipt of the above decoded signal sent by the receiving device 322 and to compare the current confirmed decoded signal with the predetermined code, thereby identifying if such decoded signal coincides with the previous encoded signal from the sensors 31. As long as the processing unit 325 cannot receive any signal transmitted by the sensors 31, the processing unit 325 would send a controlling signal to the terminal 33 through the area network 30.

In addition, the terminal 33 has an operating unit 331 receiving the controlling signal of the detecting mainframe 32 and a display unit 6 connected with the operating unit 331. Wherein, the operating unit 331 sends a warning command responsive to the controlling signal for triggering the display unit 6, so as to achieve a warning effect. The display unit 6 can be a monitor screen, a warning light, a siren etc., and it is adopted as a screen in the embodiment.

Figure 4:
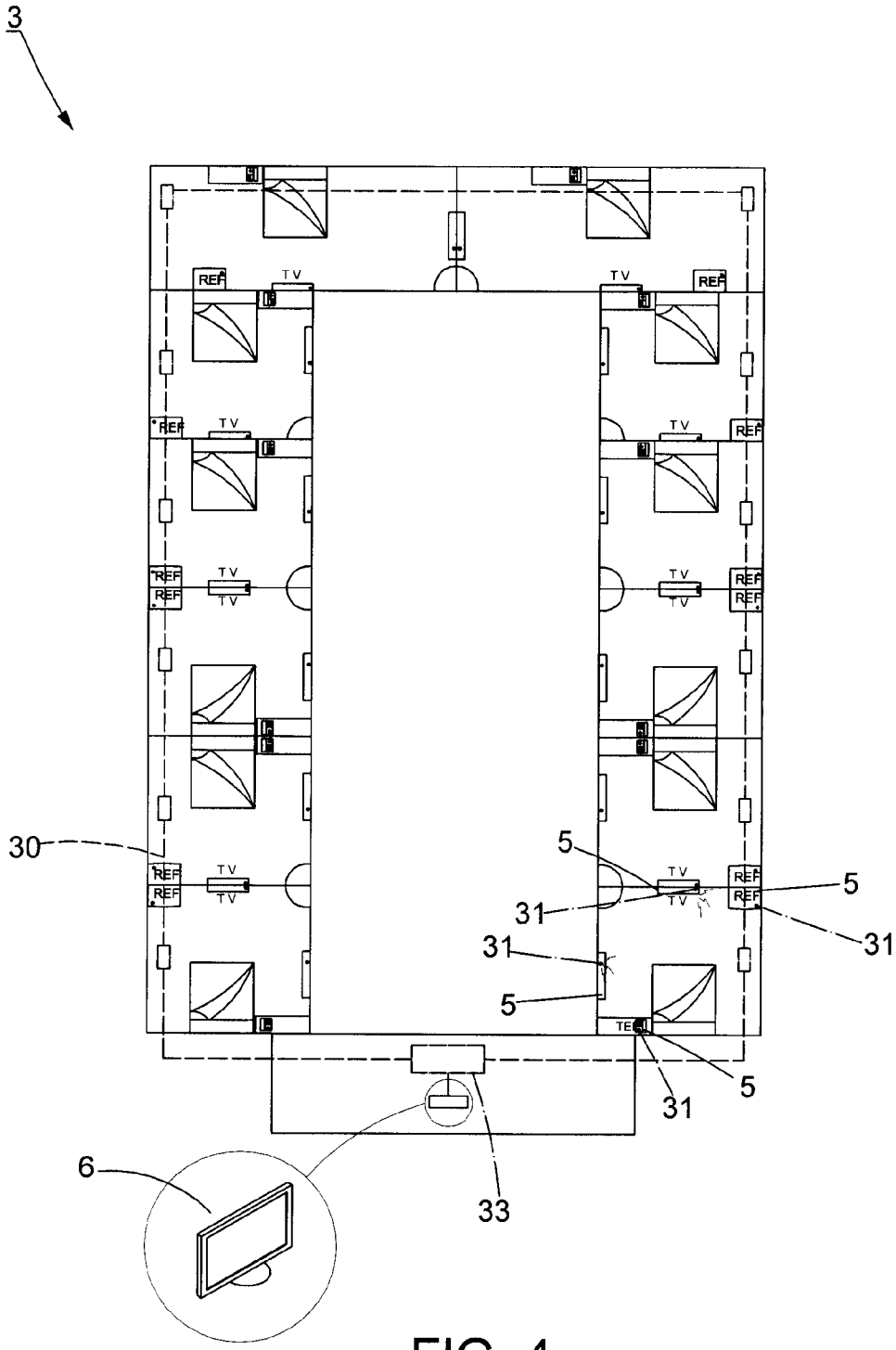
FIG. 4 is a whole plan view of the first embodiment.

Referring to FIGS. 2, 3 and 4, while installing, the present system 3 is initially instituted within each room of the protective area 4 (e.g. a motel), and the sensors 31 are installed on the movable protected objects 5 within the room, for instance TVs, DVD players, phones, desk lamps, electric appliances, paintings, ornaments, and so on. Further, the sensor power supplier 311 and the mainframe power supplier 321 are linked to a power cord of the electric appliance and directly inserted into a plug (not shown) for sufficiently supplying electricity to the sensor 31 and the detecting mainframe 32. Further, the detecting mainframe 32, shown in FIG. 3, is fixed and hidden in each protective area 4 for connecting with the area network 30, and the terminal 33 is linked to the area network 30 and placed within a manager room of the motel for a united management, hence accomplishing the advanced installation without the complex wiring.

In operation, the encoder 312 on each object 5 driven the sensor power supplier 311 creates an encoded signal and thence transform it into an analog signal sends it to the transmitter 313. The encoded signal is emitted via the transmitter. Accordingly, the detecting mainframe 32 begins to detect receipt of the analog signal intermittently sent by the transmitter 313. When the receiving device 322 receives the analog signal, it starts to analyze and decode the analog signal into a decoded signal and emits the decoded signal to the processing units 325 for further confirming, reading, and comparing. In this manner, the current confirmed decoded signal would be compared with a predetermined code stored in the memory unit 324 to recognize if the encoded signal of the sensor 31 keeps transmitted and belongs to the pair compatible to the stored code of the detecting mainframe 32 so as to prevent the system 3 from being promiscuous by strange signals. If the comparing device 323 keeps receiving the current confirmed decoded signal identical to the stored code, the processing unit 325 would not be inaction. Oppositely, if the detecting mainframe 32 does not acknowledge receipt of the identical signal generated from either of the sensors 31, the processing unit 325 would instantly output a controlling signal to the terminal 33 via the area network 30, and the operating unit 331 thence sends a warning command to the display unit 6, on which cautioned messages or images would be left for catching staff's attention in the manager room, thus efficiently attaining the warning effect and initiative alarm efficiency.

From above, the detecting mainframe 32 receives the oscillating signals (analog signals) periodically transmitted by the sensors 31 so as to prevent the premature power or battery exhaustion. Further, the detecting mainframe 32 possesses a wide receiving range without extra wiring so as to preferably accept mutual transmissions between those signals of the elements. If one of the objects 5 is away from the receiving range, the detecting mainframe 32 receives no signal from that sensor 31 and triggers the processing unit 325 to actively send a controlling signal to the terminal 33 via the area network 30, thereby efficiently establishing the cautioned information on the display unit 6 for the staff to facilely regard the condition of the objects 5 in each room, thus increasing the using convenience.

Figure 5:
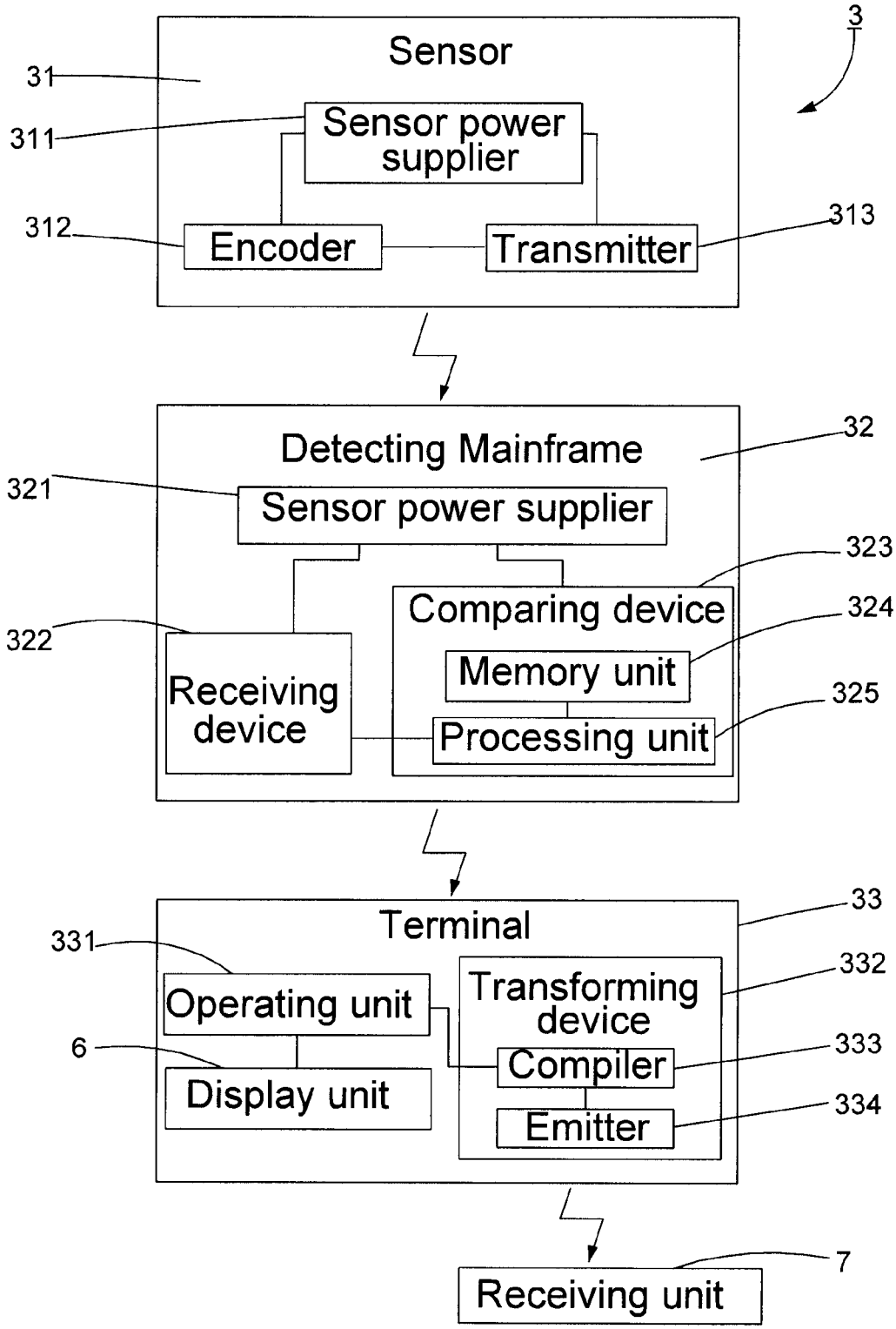
FIG. 5 is a flow diagram of a second embodiment of the present invention.

Referring to FIG. 5 shows a second preferred embodiment of the present invention that comprises sensors 31, a detecting mainframe 32, and a terminal 33, and the correlation of interrelated elements are as the same as that of the first embodiment. Particularly, this embodiment includes a transforming device 332 disposed in the terminal 33 connected with the operating unit 331 of the terminal 33 and a receiving unit 7 accepting a programmed signal generated from the transforming device 332. Wherein, the transforming device 332 is comprised of a compiler 333 and an emitter 334 connected with the compiler 333. The compiler 333 serves to receive the warning command from the operating unit 331 and concurrently re-decodes the controlling signal of the detecting mainframe 32 into a newly programmed signal. The programmed signal is thence transmitted to the receiving unit 7 via the emitter 334. The receiving unit 7 could be as a portable equipment for the users to promptly catch the situation of the terminal 33 all the time, for example, a cell phone, a wireless transceiver, and proper devices could be adopted to increase the using convenience.

Figure 6:
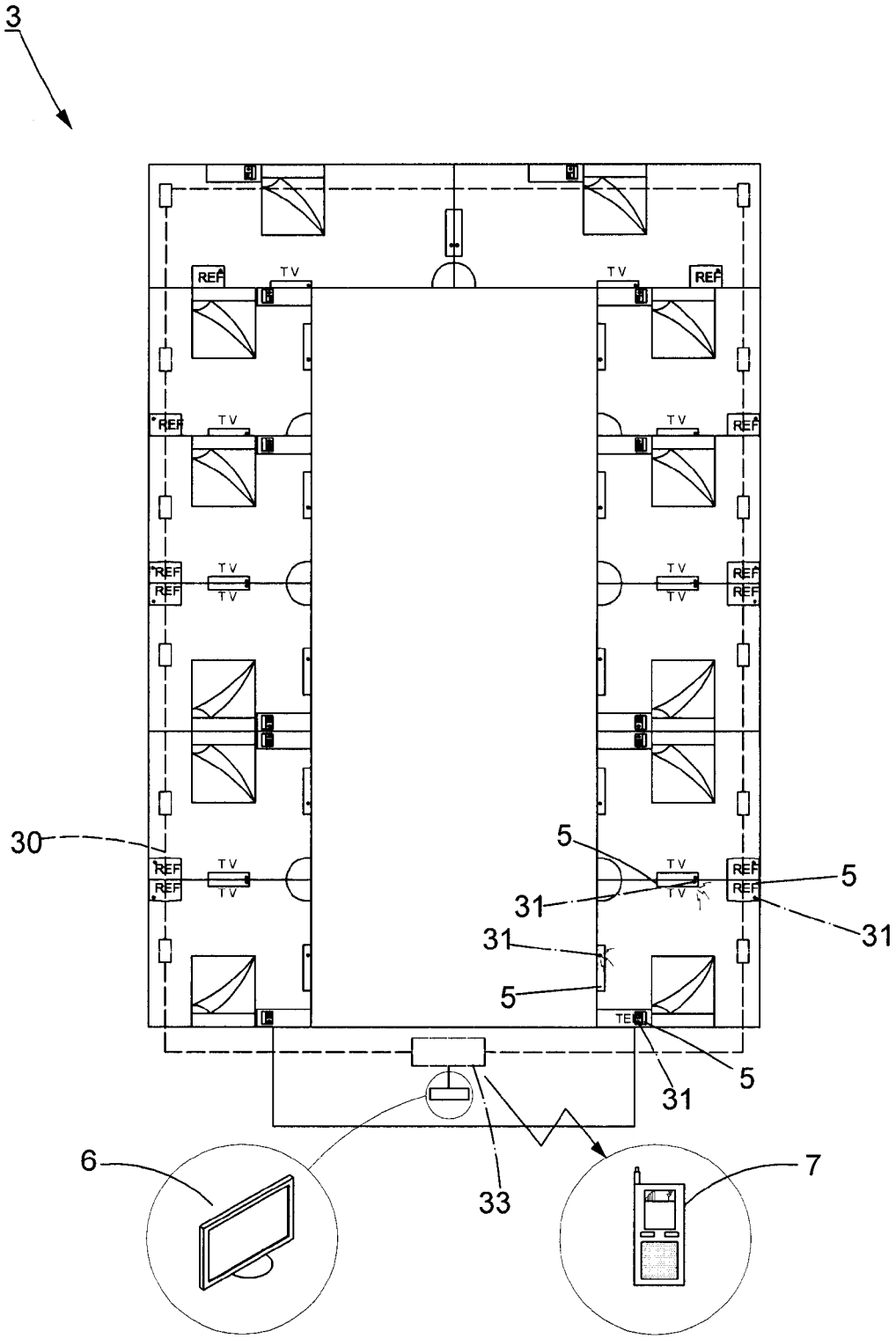
FIG. 6 is a whole plan view of the second embodiment.

Referring to FIGS. 5 and 6, the installation and operation of this embodiment as the same as the first embodiment are herein omitted. When the operating unit 331 transmits the warning command to the display unit 6, the compiler 333 of the transforming device 332 would concurrently receive the command and generate a newly programmed signal with respect to the controlling signal of the mainframe 32, so that the programmed signal is thence output from the emitter 334 to the receiving unit 7. Therefore, although the staff may be far away from the display unit 6, they can be instantly bound for the room to check the conditions of the protected objects 5 while noticing the warning messages under the assistance of the receiving unit 7, so as to competently prevent from stealing and enhance an active warning efficiency.

To sum up, the present invention takes advantage of the incessant or intermittent signals transmission between the sensors and the detecting mainframe for confirming if the protected objects are well placed within the protective area. Once the objects are taken away, the area network would immediately trigger the terminal for obtaining a timely and active warning effect, so as to effectively prevent the objects from being stolen. Thus, the present invention not only applies an effective correlation between the correlated elements but utilizes the area network to accomplish a preferable warning effect via the initiative notice of signals, hence attaining a streamlined installation and a convenient utilization and application.

Besides the above preferred embodiments, it will be understood that various modifications may be made and the appended claims are intended to cover all modifications without departing from the spirit and the scope of the invention.

I claim:

1. An initiative warning system comprising:

a protective area for containing objects, in which an area network being defined to connect with an exterior;

a plurality of sensors respectively disposed on said objects; each sensor having a sensor power supplier respectively attached to an encoder and a transmitter; wherein, said sensor power supplier providing said encoder and said transmitter with electricity; said encoder connecting to said transmitter so that a signal generated by said encoder being passed to said transmitter and said transmitter serving to output said signal;

a detecting mainframe connected with said area network and having a mainframe power supplier respectively connected with a receiving device and a comparing device; wherein, said receiving device receiving said signal output by said transmitter and proceeding to recognize and decode said signal into a decoded signal; said comparing device including a memory unit for saving a predetermined code compatible with said signal generated by said sensor and a processing unit connected with said memory unit for confirming receipt of said decoded signal and comparing said current confirmed decoded signal with said predetermined code; said processing unit outputting a controlling signal through said area network while said receiving device failing to receive said signal from either of said sensors; and a terminal connected with said detecting mainframe by said area network; said terminal further having an operating unit responsive to said detecting mainframe and a display unit connected with said operating unit; wherein, said operating unit receiving said controlling signal transmitted by said processing unit and responsively sending a warning command to trigger said display unit;

wherein said terminal further includes a transforming device comprising a compiler for receiving said warning command of said operating unit and an emitter that is connected with said compiler; said compiler proceeds to re-encode said controlling signal of said detecting mainframe into a newly programmed signal and transmits said programmed signal toward said emitter for emitting.

2. The initiative warning system as claimed in claim 1, wherein, said transmitter is operable to intermittently emit said signal at intervals.

3. The initiative warning system as claimed in claim 1, wherein, a corresponsive receiving unit receives said newly programmed signal emitted by said emitter.

4. The initiative warning system as claimed in claim 1, wherein, said display unit is a warning light.

5. The initiative warning system as claimed in claim 1, wherein said display unit is a monitor screen.

* * * * *